US011503681B2

(12) United States Patent
Yamashita et al.

(10) Patent No.: US 11,503,681 B2
(45) Date of Patent: Nov. 15, 2022

(54) LIGHTING DEVICE FOR VEHICLE

(71) Applicant: TOYOTA JIDOSHA KABUSHIKI KAISHA, Toyota (JP)

(72) Inventors: Masahiro Yamashita, Toyota (JP); Yoshiharu Okabe, Toyota (JP); Mitsuhisa Shida, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/400,506

(22) Filed: Aug. 12, 2021

(65) Prior Publication Data

US 2022/0053616 A1 Feb. 17, 2022

(30) Foreign Application Priority Data

Aug. 17, 2020 (JP) ..... JP2020-137611

(51) Int. Cl.

| | |
|---|---|
| ***F21V 21/26*** | (2006.01) |
| ***H05B 45/10*** | (2020.01) |
| ***H05B 45/37*** | (2020.01) |
| ***H05B 45/50*** | (2022.01) |
| ***H05B 45/14*** | (2020.01) |
| ***H05B 45/38*** | (2020.01) |
| ***F21V 29/70*** | (2015.01) |
| ***F21S 8/08*** | (2006.01) |
| ***F21V 31/00*** | (2006.01) |
| ***F21S 41/143*** | (2018.01) |
| *F21Y 115/10* | (2016.01) |

(52) U.S. Cl.

CPC ..... *H05B 45/10* (2020.01); *F21S 41/143* (2018.01); *F21Y 2115/10* (2016.08)

(58) Field of Classification Search

CPC .... H05B 45/10; F21S 41/143; F21Y 2115/10; B60Q 2300/23; B60Q 2300/32; B60Q 1/143

See application file for complete search history.

(56) References Cited

U.S. PATENT DOCUMENTS 9,227,555 B2 * 1/2016 Kalapodas ..... B60Q 1/04
2014/0009065 A1 1/2014 Sasaki et al.
(Continued)

FOREIGN PATENT DOCUMENTS

JP 2014-012493 A 1/2014

*Primary Examiner* — Andrew J Coughlin
*Assistant Examiner* — Jessica M Apenteng
(74) *Attorney, Agent, or Firm* — Sughrue Mion, PLLC

(57) ABSTRACT

A lighting device for a vehicle includes a light emission units, a control device, and an operating unit to be operated when the vehicle is started. The control device increases an emission intensity of light emission units in a first period. The first period includes a second period including a plurality of time intervals. The control device changes the emission intensity of light emission units in each time interval of the second period so that two light emission units in at least one pair of light emission units adjacent to each other differ from each other in light emission parameters. The light emission parameters include at least two parameters out of a magnitude of changing amount in emission intensity in the time interval, a direction indicating whether the emission intensity is increasing or decreasing in the time interval, and the emission intensity at an end point of the time interval.

4 Claims, 7 Drawing Sheets

(56) References Cited

U.S. PATENT DOCUMENTS

| | | | | |
|---|---|---|---|---|
| 2015/0307018 | A1* | 10/2015 | Shibata | B60Q 1/143<br>362/466 |
| 2020/0047661 | A1* | 2/2020 | Takii | F21S 41/32 |
| 2020/0088371 | A1* | 3/2020 | Totsuka | F21S 41/192 |
| 2020/0207254 | A1* | 7/2020 | Iriba | F21V 23/0464 |
| 2020/0238895 | A1* | 7/2020 | Shibata | B60Q 1/143 |

* cited by examiner

| | 33L-1 | 33L-2 | 33L-3 | ··· | 33L-n |
|---|---|---|---|---|---|
| t0 | 0 | 0 | 0 | ··· | 0 |
| t1 | 5 | 12 | 11 | ··· | 10 |
| t2 | 21 | 12 | 23 | ··· | 25 |
| t3 | 23 | 33 | 27 | ··· | 21 |
| t4 | 52 | 28 | 43 | ··· | 38 |
| t5 | 50 | 49 | 43 | ··· | 50 |
| t6 | 55 | 79 | 66 | ··· | 55 |
| t7 | 65 | 85 | 76 | ··· | 58 |
| t8 | 77 | 99 | 88 | ··· | 70 |
| t9 | 95 | 102 | 100 | ··· | 86 |
| t10 | 100 | 100 | 100 | ··· | 100 |
| t11 | 100 | 100 | 100 | ··· | 100 |
| t12 | 100 | 100 | 100 | ··· | 100 |
| t13 | 100 | 100 | 100 | ··· | 100 |
| t14 | 100 | 100 | 100 | ··· | 100 |

FIG.5

| | 33L-1 | | 33L-2 | | 33L-3 | | … | | 33L-n | | SUM OF VALUES OF EMISSION INTENSITY cd |
|---|---|---|---|---|---|---|---|---|---|---|---|
| t0 | 0 | + | 0 | + | 0 | + | … | + | 0 | → | SL_t0 |
| t1 | 5 | + | 12 | + | 11 | + | … | + | 10 | → | SL_t1 |
| t2 | 21 | + | 12 | + | 23 | + | … | + | 25 | → | SL_t2 |
| t3 | 23 | + | 33 | + | 27 | + | … | + | 21 | → | SL_t3 |
| t4 | 52 | + | 28 | + | 43 | + | … | + | 38 | → | SL_t4 |
| t5 | 50 | + | 49 | + | 43 | + | … | + | 50 | → | SL_t5 |
| t6 | 55 | + | 79 | + | 66 | + | … | + | 55 | → | SL_t6 |
| t7 | 65 | + | 85 | + | 76 | + | … | + | 58 | → | SL_t7 |
| t8 | 77 | + | 99 | + | 88 | + | … | + | 70 | → | SL_t8 |
| t9 | 95 | + | 102 | + | 100 | + | … | + | 86 | → | SL_t9 |
| t10 | 100 | + | 100 | + | 100 | + | … | + | 100 | → | SL_t10 |
| t11 | 100 | | 100 | | 100 | | … | | 100 | | |
| t12 | 100 | | 100 | | 100 | | … | | 100 | | |
| t13 | 100 | | 100 | | 100 | | … | | 100 | | |
| t14 | 100 | | 100 | | 100 | | … | | 100 | | |

FIG.6

| | 33L-1 | 33L-2 | 33L-3 | … | 33L-n | REFERENCE VALUE cd_ref | EMISSION INTENSITY RANGE |
|---|---|---|---|---|---|---|---|
| t0 | 0 | 0 | 0 | … | 0 | 0 | |
| t1 | 5 | 12 | 11 | … | 10 | 10 | 5～15 |
| t2 | 21 | 12 | 23 | … | 25 | 20 | 10～30 |
| t3 | 23 | 33 | 27 | … | 21 | 30 | 15～45 |
| t4 | 52 | 28 | 43 | … | 38 | 40 | 20～60 |
| t5 | 50 | 49 | 43 | … | 50 | 50 | 25～75 |
| t6 | 55 | 79 | 66 | … | 55 | 60 | 30～90 |
| t7 | 65 | 85 | 76 | … | 58 | 70 | 35～105 |
| t8 | 77 | 99 | 88 | … | 70 | 80 | 40～120 |
| t9 | 95 | 102 | 100 | … | 86 | 90 | 45～135 |
| t10 | 100 | 100 | 100 | … | 100 | 100 | |
| t11 | 100 | 100 | 100 | … | 100 | | |
| t12 | 100 | 100 | 100 | … | 100 | | |
| t13 | 100 | 100 | 100 | … | 100 | | |
| t14 | 100 | 100 | 100 | … | 100 | | |

FIG.7

400R

Tp1, Tp2, ti_1, ti_2, ti_3, ti_4, ti_5, ti_6, ti_7, ti_8, ti_9, ti_10

| | 33R-1 | 33R-2 | 33R-3 | … | 33R-n |
|---|---|---|---|---|---|
| t0 | 0 | 0 | 0 | … | 0 |
| t1 | 10 | 6 | 11 | … | 7 |
| t2 | 25 | 11 | 21 | … | 14 |
| t3 | 21 | 33 | 29 | … | 32 |
| t4 | 38 | 45 | 38 | … | 46 |
| t5 | 50 | 42 | 38 | … | 71 |
| t6 | 55 | 50 | 66 | … | 77 |
| t7 | 58 | 51 | 72 | … | 85 |
| t8 | 70 | 78 | 85 | … | 91 |
| t9 | 86 | 91 | 101 | … | 99 |
| t10 | 100 | 100 | 100 | … | 100 |
| t11 | 100 | 100 | 100 | … | 100 |
| t12 | 100 | 100 | 100 | … | 100 |
| t13 | 100 | 100 | 100 | … | 100 |
| t14 | 100 | 100 | 100 | … | 100 |

FIG.8

| | 33R-1 | 33R-2 | 33R-3 | … | 33R-n | REFERENCE VALUE cd_ref | EMISSION INTENSITY RANGE |
|---|---|---|---|---|---|---|---|
| t0 | 0 | 0 | 0 | … | 0 | 0 | |
| t1 | 10 | 6 | 11 | … | 7 | 10 | 5～15 |
| t2 | 25 | 11 | 21 | … | 14 | 20 | 10～30 |
| t3 | 21 | 33 | 29 | … | 32 | 30 | 15～45 |
| t4 | 38 | 45 | 38 | … | 46 | 40 | 20～60 |
| t5 | 50 | 42 | 38 | … | 71 | 50 | 25～75 |
| t6 | 55 | 50 | 66 | … | 77 | 60 | 30～90 |
| t7 | 58 | 51 | 72 | … | 85 | 70 | 35～105 |
| t8 | 70 | 78 | 85 | … | 91 | 80 | 40～120 |
| t9 | 86 | 91 | 101 | … | 99 | 90 | 45～135 |
| t10 | 100 | 100 | 100 | … | 100 | 100 | |
| t11 | 100 | 100 | 100 | … | 100 | | |
| t12 | 100 | 100 | 100 | … | 100 | | |
| t13 | 100 | 100 | 100 | … | 100 | | |
| t14 | 100 | 100 | 100 | … | 100 | | |

FIG.10

400L_a

Tp1 Tp2

| | 33L-1 | 33L-2 | 33L-3 | ··· | 33L-n |
|---|---|---|---|---|---|
| t0 | 0 | 0 | 0 | ··· | 0 |
| t1 | 10 | 10 | 10 | ··· | 10 |
| t2 | 20 | 20 | 20 | ··· | 20 |
| t3 | 30 | 30 | 30 | ··· | 30 |
| t4 | 52 | 28 | 43 | ··· | 38 |
| t5 | 50 | 49 | 43 | ··· | 50 |
| t6 | 55 | 79 | 66 | ··· | 55 |
| t7 | 65 | 85 | 76 | ··· | 58 |
| t8 | 77 | 99 | 88 | ··· | 70 |
| t9 | 90 | 90 | 90 | ··· | 90 |
| t10 | 100 | 100 | 100 | ··· | 100 |
| t11 | 100 | 100 | 100 | ··· | 100 |
| t12 | 100 | 100 | 100 | ··· | 100 |
| t13 | 100 | 100 | 100 | ··· | 100 |
| t14 | 100 | 100 | 100 | ··· | 100 |

FIG.11

400L_b

Tp1 Tp2

| | 33L-1 | 33L-2 | 33L-3 | ··· | 33L-n |
|---|---|---|---|---|---|
| t0 | 0 | 0 | 0 | ··· | 0 |
| t1 | 5 | 10 | 10 | ··· | 10 |
| t2 | 21 | 20 | 20 | ··· | 20 |
| t3 | 23 | 30 | 30 | ··· | 30 |
| t4 | 52 | 40 | 40 | ··· | 40 |
| t5 | 51 | 50 | 50 | ··· | 50 |
| t6 | 55 | 60 | 60 | ··· | 60 |
| t7 | 63 | 70 | 70 | ··· | 70 |
| t8 | 77 | 80 | 80 | ··· | 80 |
| t9 | 95 | 90 | 90 | ··· | 90 |
| t10 | 100 | 100 | 100 | ··· | 100 |
| t11 | 100 | 100 | 100 | ··· | 100 |
| t12 | 100 | 100 | 100 | ··· | 100 |
| t13 | 100 | 100 | 100 | ··· | 100 |
| t14 | 100 | 100 | 100 | ··· | 100 |

LIGHTING DEVICE FOR VEHICLE

BACKGROUND OF THE INVENTION

1. Field of the Invention

The present invention relates to a lighting device for a vehicle which is configured to control an emission intensity of each of a plurality of light emission units mounted in a front part of the vehicle.

2. Description of the Related Art

There has hitherto been proposed a lighting device for a vehicle configured to use light from a light emission unit to alert people (pedestrians, drivers of other vehicles, and the like) present around the vehicle to the fact that the vehicle is about to start moving.

In Japanese Patent Application Laid-open No. 2014-12493, for example, there is described a device (hereinafter referred to as "related-art device") including a plurality of limit emission units (light source units) in a front part of a vehicle. The plurality of light emission units are aligned in a single line in a vehicle width direction (a left-right direction). The related-art device executes lighting control in which three of the light emission units that are adjacent to one another are selectively lit when a state of an ignition switch of the vehicle is changed from an off state to an on state. Thus, the related-art device can calls the attention of pedestrians before the vehicle starts to move.

The related-art device shifts a light emission area (three light emission units) from a left side to a right side in the lighting control. With this lighting control, however, the light emission area simply shifts in one direction, and the simple shift fails to draw the attention of people present around the vehicle in some cases. For instance, in a situation in which the vehicle turns, the light emission area of a headlight shifts in one direction. Pedestrians are routinely accustomed to seeing such a shift of the light emission area in one direction as this, and therefore may not pay attention to the lighting control by the related-art device.

SUMMARY OF THE INVENTION

It is therefore an object of the present invention to provide a lighting device for a vehicle which is capable of drawing attention of people present around the vehicle before the vehicle starts to move.

According to at least one embodiment of the present invention, there is provided a lighting device for a vehicle including: a plurality of light emission units (33L-1 to 33L-n and 33R-1 to 33R-n) mounted in a front part of the vehicle and aligned in a predetermined direction; a control device (10) configured to control an emission intensity (cd) of each of the plurality of light emission units; and an operating unit (50) to be operated by a driver when driving of the vehicle is started. The control device is configured to execute a specific lighting control in which the emission intensity of each of the plurality of light emission units is changed so that the emission intensity of each of the plurality of light emission units is equal to or higher than a predetermined first intensity (cd1) at an end point of a first period (Tp1). The first period is a period that starts from an operation point at which the operating unit is operated and ends when a length of time elapsed since the operation point reaches a predetermined first time (Tm1). Further, the first period includes a second period (Tp2), the second period including a plurality of time intervals (ti_1, . . . , ti_10).

The control device is configured to execute the specific lighting control so that, in each of the plurality of time intervals of the second period, the light emission units in at least one pair of light emission units adjacent to each other out of the plurality of light emission units differ from each other in light emission parameters.

The light emission parameters include at least two parameters out of a magnitude of a changing amount of the emission intensity in each of the plurality of time intervals, a direction indicating whether the emission intensity is increasing or decreasing in each of the plurality of time intervals, and the emission intensity at an end point of each of the plurality of time intervals.

The lighting device having the configuration described above increases the emission intensity of each of the plurality of light emission units to an intensity equal to or higher than the first intensity in response to operation performed on the operating unit. The lighting device further changes the emission intensities of at least some of the light emission units (the at least one pair of adjacent light emission units described above) in an irregular pattern. The emission intensities of at least some of the light emission units thus irregularly change, with each of the plurality of light emission units increasing in emission intensity. The illumination device can draw the attention of people present around the vehicle in this manner.

According to at least one aspect of the present invention, the control device is configured to execute the specific lighting control so that a sum of values each indicating the emission intensity of each of the plurality of light emission units (SL_t0 to SL_t10 and SR_t0 to SR_t10) gradually increases in the second period.

According to the configuration described above, the degree of overall brightness of the plurality of light emission units gradually increases without dropping at some point. This enhances the effect of calling the attention of people present around the vehicle.

According to at least one aspect of the present invention, the control device is configured to execute the specific lighting control so that the emission intensity of each of the plurality of light emission units falls within a predetermined range at an end point (t1, . . . , t9) of each of the plurality of time intervals.

According to the configuration described above, the emission intensity of each light emission unit falls within the predetermined range at the end point of each time interval. Each of the plurality of light emission units can accordingly be prevented from being reduced and increased in emission intensity to an extreme level.

According to at least one aspect of the present invention, the plurality of light emission units include a plurality of first light emission units (33L-1 to 33L-n) provided on a left side of the front part of the vehicle, and a plurality of second light emission units (33R-1 to 33R-n) provided on a right side of the front part of the vehicle.

The control device is configured to: execute the specific lighting control so that, in each of the plurality of time intervals of the second period, the first light emission units in at least one pair of the first light emission units adjacent to each other out of the plurality of first light emission units differ from each other in the light emission parameters; and execute the specific lighting control so that, in each of the plurality of time intervals of the second period, the second light emission units in at least one pair of the second light emission units adjacent to each other out of the plurality of second light emission units differ from each other in the light emission parameters.

Further, in the second period, a pattern of changes in the emission intensity of each of the plurality of first light emission units and a pattern of changes in the emission intensity of each of the plurality of second light emission units differ from each other.

According to the configuration described above, the emission intensity of the plurality of first light emission units and the emission intensity of the plurality of second light emission units change in different patterns, and the effect of drawing the attention of people present around the vehicle can accordingly be enhanced even more.

In one or more embodiments, the above-mentioned control device may be implemented by a microprocessor programmed to execute one or more functions described herein. In one or more embodiments, the control device may be implemented entirely or partially by hardware formed of an integrated circuit specialized for one or more applications, namely, for example, an ASIC. In the above description, in order to facilitate understanding of the present invention, names and/or reference symbols used in at least one embodiment of the present invention described below are enclosed in parentheses and are assigned to each of the constituent features of the invention corresponding to the at least one embodiment. However, each of the constituent features of the present invention is not limited to the at least one embodiment defined by the names and/or reference symbols.

BRIEF DESCRIPTION OF THE DRAWINGS

FIG. 5 is a table for showing changes in emission intensity of each of the plurality of light emission units of the left high beam light.

FIG. 6 is a table for showing changes in emission intensity of each of the plurality of light emission units of the left high beam light.

FIG. 7 is an example of a table defining changes in emission intensity of each of a plurality of light emission units of the right high beam light with time.

FIG. 8 is a table for showing changes in emission intensity of each of the plurality of light emission units of the right high beam light.

FIG. 10 is a modification example of the table defining changes in emission intensity of each of the plurality of light emission units of the left high beam light with time.

FIG. 11 is a modification example of the table defining changes in emission intensity of each of the plurality of light emission units of the left high beam light with time.

DESCRIPTION OF THE EMBODIMENTS

<Configuration>

Figure 1:
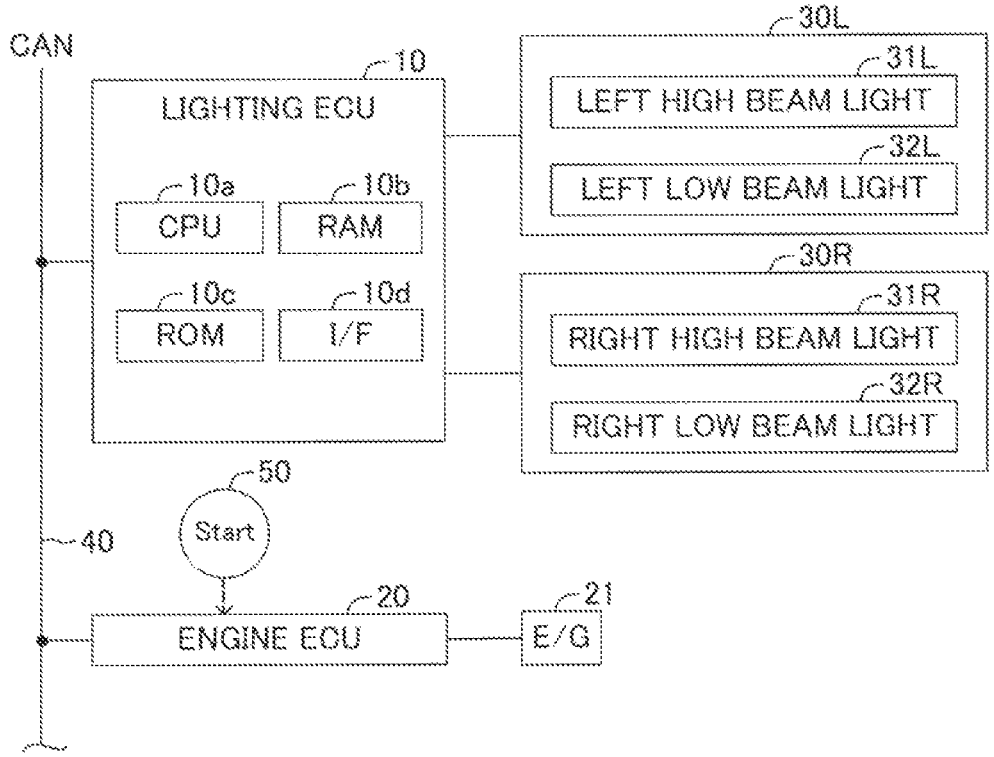
FIG. 1 is a schematic diagram for illustrating a configuration of a lighting device for a vehicle according to at least one embodiment of the present invention.

A lighting device according to at least one embodiment of the present invention is mounted on a vehicle. As illustrated in FIG. 1, the lighting device includes a lighting ECU 10 and an engine ECU 20.

Those ECUs are electronic control units (ECUs) each including a microcomputer as a main part, and are connected to one another so as to be able to mutually transmit and receive information via a controller area network (CAN) 40. The microcomputer herein includes a CPU, a RAM, a ROM, an interface (I/F), and the like. For example, the lighting ECU 10 includes a microcomputer including a CPU 10*a*, a RAM 10*b*, a ROM 10*c*, an interface (I/F) 10*d*, and the like. The CPU 10*a* is configured to execute instructions (programs and routines) stored in the ROM 10*c* to implement various functions described below.

Various ECUs configured to execute vehicle control (for example, a brake ECU and a steering ECU) are connected to the CAN 40, but are not directly relevant to the lighting device according to the at least one embodiment. Descriptions thereof are therefore omitted.

The lighting ECU 10 is connected to a left headlight 30L and a right headlight 30R. The lighting ECU 10 can control each of the left headlight 30L and the right headlight 30R separately.

Figure 2:
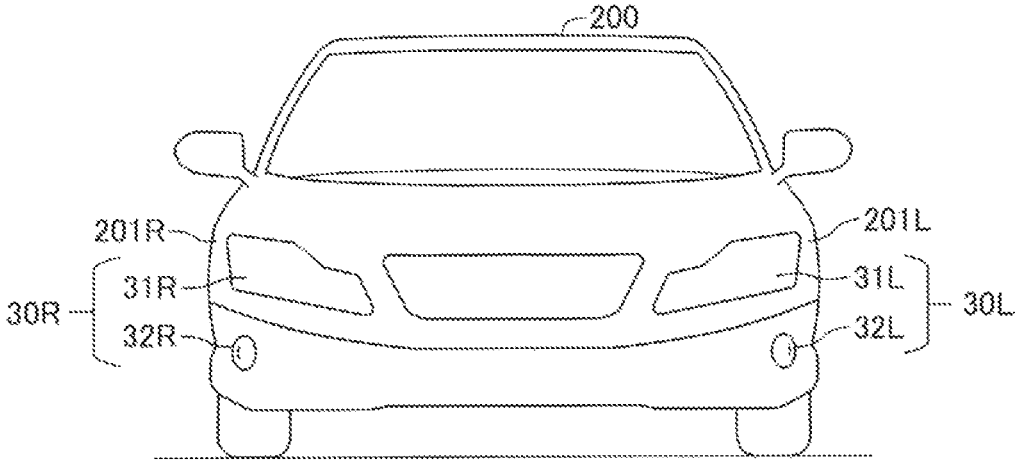
FIG. 2 is a front view of a vehicle for illustrating arrangement of a left headlight and a right headlight.

As illustrated in FIG. 2, the left headlight 30L is provided on a left side of a front part (a left front corner portion 201L) of a vehicle 200, and the right headlight 30R is provided on a right side of the front part (a right front corner portion 201R) of the vehicle 200. The left headlight 30L and the right headlight 30R have the same basic configuration. The left headlight 30L include a left high beam light 31L and a left low beam light 32L. The right headlight 30R includes a right high beam light 31R and a right low beam light 32R.

Referring back to FIG. 1, the engine ECU 20 is connected to a starter switch 50. The starter switch 50 is an operating unit to be operated by a driver when driving of the vehicle is started. Specifically, the starter switch 50 is a switch operated when a driving source (an engine 21 in this example) is started, and may also be referred to as "engine start switch" or "ignition switch". The engine ECU 20 starts the engine 21 when the state of the starter switch 50 is changed from an off state to an on state. The engine ECU 20 is configured to transmit a signal indicating the state (off state or on state) of the starter switch 50 to the lighting ECU 10 via the CAN 40.

The engine ECU 20 can further change torque generated by the engine 21, by driving an engine actuator (not shown). The engine ECU 20 can accordingly control a driving force of the vehicle by controlling the engine actuator.

When the vehicle is a hybrid vehicle, the engine ECU 20 can control a driving force generated by any one or both of "an internal combustion engine and an electric motor" serving as vehicle drive sources. In addition, when the vehicle is an electric vehicle, the engine ECU 20 can control the driving force generated by the electric motor serving as the vehicle drive source. The hybrid vehicle or the electric vehicle includes, for example, a ready switch. The ready switch is an operating unit operated by the driver when the driving of the vehicle is started. When the state of the ready switch is changed from an off state to an on state, the state of the vehicle is changed to "a state in which the vehicle can run (an activated state)." That the ready switch is in the on state equals that the starter switch 50 is in the on state.

<Configuration of High Beam Lights>

The left high beam light 31L and the right high beam light 31R are each configured to irradiate space in front of the vehicle with light (a high beam). In this example, an adaptive high beam system (hereinafter abbreviated as "AHS") is installed in the lighting device. The AHS is a known system (see, for example, Japanese Patent Application Laid-open No. 2017-140947 and Japanese Patent Application Laid-open No. 2018-020683). The AHS is a system configured to change an irradiation area of each of the left high beam light 31L and the right high beam light 31R based on "information about a situation of surroundings of the vehicle," which is obtained by a sensor (not shown) (for example, a camera sensor).

Figure 3:
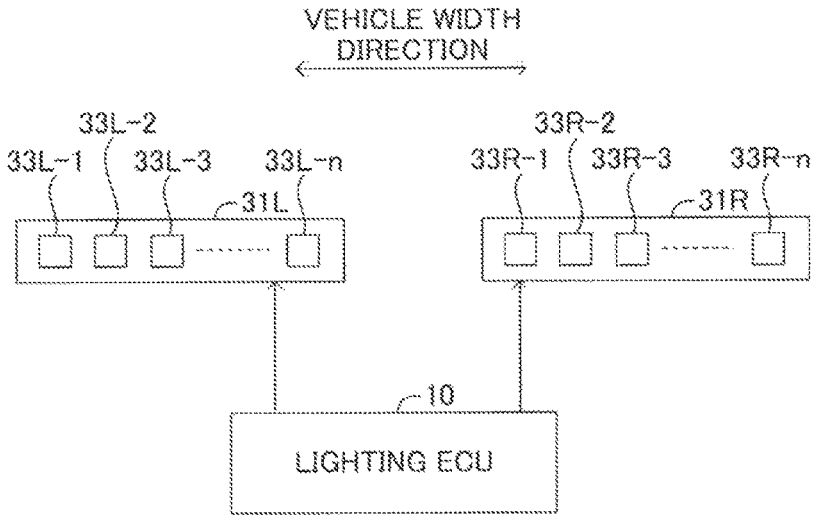
FIG. 3 is a diagram for illustrating a configuration of a left high beam light and a right high beam light.

As illustrated in FIG. 3, the left high beam light 31L includes a plurality of (n) light emission units (33L-1, 33L-2, 33L-3, . . . , 33L-n) aligned in a vehicle width direction (a left-right direction of the vehicle). The right high beam light 31R includes a plurality of (n) light emission units (33R-1, 33R-2, 33R-3, . . . , 33R-n) aligned in the vehicle width direction.

The left high beam light 31L and the right high beam light 31R have the same configuration, and the configuration of the left high beam light 31L is accordingly described below. The plurality of light emission units in the left high beam light 31L are hereinafter collectively referred to as "a plurality of light emission units 33L." The plurality of light emission units 33L each include a white light emitting diode (LED).

The lighting ECU 10 can control a lit state of each of the plurality of light emission units 33L independently of one another. That is, the lighting ECU 10 can selectively light one or more light emission units out of the plurality of light emission units 33L. The lighting ECU 10 can further control the emission intensity of each of the plurality of light emission units 33L by adjusting the amount of current supplied to each of the plurality of light emission units 33L. Here, the "emission intensity" means the degree of brightness of light emitted in one direction. The emission intensity is, for example, luminous intensity (cd), which is the amount of luminous flux per unit solid angle (hereinafter referred to as "emission intensity cd").

As a technology of controlling each of the plurality of light emission units (LEDs) independently of one another, one of technologies described in, for example, Japanese Patent Application Laid-open No. 2009-123566, Japanese Patent Application Laid-open No. 2008-37240, and Japanese Patent Application Laid-open No. 2008-114800 may be employed.

<Specific Lighting Control of High Beam Lights>

When the state of the starter switch 50 is changed from the off state to the on state, the lighting ECU 10 lights the left high beam light 31L and the right high beam light 31R in a specific mode described below. A point in time at which the state of the starter switch 50 is changed from the off state to the on state (that is, a point in time at which the driver operates the starter switch 50) is hereinafter simply referred to as "on-point (or operation point)." Further, lighting control performed immediately after the on-point is referred to as "specific lighting control."

The specific lighting control is control in which the emission intensity cd of each of the plurality of light emission units 33L is changed so that the emission intensity cd of each of the plurality of light emission units 33L reaches a predetermined first intensity cd1 at an end point of a first period Tp1. The first period Tp1 is a period starting at the on-point and ending when the length of time elapsed since the on-point reaches a predetermined first time Tm1. The lighting ECU 10 can alert people (pedestrians, drivers of other vehicles, and the like) present around the vehicle to the fact that the vehicle is about to start moving by executing the specific lighting control.

Figure 4:
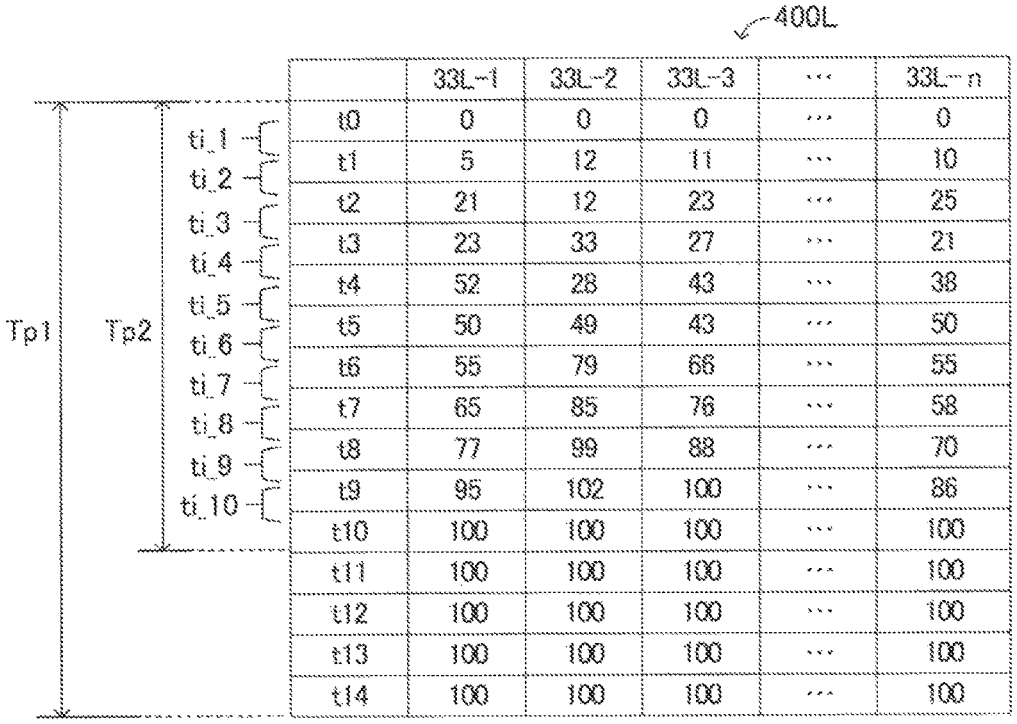
FIG. 4 is an example of a table defining changes in emission intensity of each of a plurality of light emission units of the left high beam light with time.

The lighting ECU 10 stores a table 400L shown in FIG. 4 on the ROM 10*c* in advance. The table 400L defines, for each of the plurality of light emission units 33L, changes with time of the emission intensity cd that are observed in the light emission unit when the specific lighting control is executed. In the table 400L, the emission intensity cd of each of the plurality of light emission units 33L is normalized with the first intensity cd1 as "100". The first intensity cd1 is set to any value at which light is visually recognizable by a person within a predetermined range from the vehicle. The lighting ECU 10 controls the emission intensity cd of each of the plurality of light emission units 33L (that is, executes the specific lighting control) based on the table 400L and the time elapsed since the on-point.

A point t0 is the on-point (a starting point of the specific lighting control). A point t14 is an end point of the specific lighting control. The first period Tp1 is a period from the point t0 to the point t14 (=Tm1). At the end point t14 of the first period Tp1, the emission intensity cd of each of the plurality of light emission units 33L is the first intensity cd1 ("100" in the table 400L).

The first period Tp1 includes a second period Tp2. The second period Tp2 is a part of the first period Tp1 and, in this example, is a period from the point t0 to a point t10. The second period Tp2 includes a plurality of (ten) time intervals (ti_1, . . . , ti_10). Any one time interval out of the plurality of time intervals described above is hereinafter expressed as "time interval ti_j" (j=1, . . . , 10).

According to the table 400L, in each time interval ti_j of the second period Tp2, two light emission units 33L arranged next to each other differ from each other in at least two of the following light emission parameters. The light emission parameters include a magnitude (an absolute value) of the changing amount of the emission intensity cd in the time interval ti_j, a direction of the change of the emission intensity cd in the time interval ti_j, and the emission intensity cd at an end point of the time interval ti_j. The direction of the change of the emission intensity cd means a direction in which the emission intensity cd increases or decreases, and includes "increase", "decrease", and "no change".

For example, the light emission parameters of the light emission unit 33L-1 in a first time interval ti_1 from the point t0 to a point t1 are as follows.

The magnitude of the changing amount of the emission intensity cd: 5

The direction of the change of the emission intensity cd: increase

The emission intensity cd at the end point of the first time interval ti_1 (namely, the point t1): 5

The light emission parameters of the "light emission unit 33L-2 adjacent to the light emission unit 33L-1" in the first time interval ti_1 are as follows.

The magnitude of the changing amount of the emission intensity cd: 12

The direction of the change of the emission intensity cd: increase

The emission intensity cd at the end point of the first time interval ti_1: 12

The light emission parameters of the "light emission unit 33L-3 adjacent to the light emission unit 33L-2" in the first time interval ti_1 are as follows.

The magnitude of the changing amount of the emission intensity cd: 11

The direction of the change of the emission intensity cd: increase

The emission intensity cd at the end point of the first time interval ti_1: 11

As described above, in the first time interval ti_1, the light emission units 33L-1 and 33L-2 adjacent to each other differ from each other in two of the light emission parameters (specifically, the magnitude of the changing amount of the emission intensity cd and the emission intensity cd at the end point of the first time interval ti_1). In the first time interval ti_1, the light emission units 33L-2 and 33L-3 adjacent to each other also differ from each other in two of the light emission parameters (specifically, the magnitude of the changing amount of the emission intensity cd and the emission intensity cd at the end point of the first time interval ti_1).

For example, the light emission parameters of the light emission unit 33L-1 in a second time interval ti_2 from the point t1 to a point t2 are as follows.

The magnitude of the changing amount of the emission intensity cd: 16

The direction of the change of the emission intensity cd: increase

The emission intensity cd at the end point of the second time interval ti_2 (namely, the point t2): 21

The light emission parameters of the light emission unit 33L-2 in the second time interval ti_2 are as follows.

The magnitude of the changing amount of the emission intensity cd: 0

The direction of the change of the emission intensity cd: no change

The emission intensity cd at the end point of the second time interval ti_2: 12

The light emission parameters of the light emission unit 33L-3 in the second time interval ti_2 are as follows.

The magnitude of the changing amount of the emission intensity cd: 12

The direction of the change of the emission intensity cd: increase

The emission intensity cd at the end point of the second time interval ti_2: 23

As described above, in the second time interval ti_2, the light emission units 33L-1 and 33L-2 adjacent to each other differ from each other in all of the light emission parameters. In the second time interval ti_2, the light emission units 33L-2 and 33L-3 adjacent to each other also differ from each other in all of the light emission parameters.

Any one light emission unit out of the plurality of light emission units 33L is expressed as "light emission unit 33L-m" (m=1, . . . , n−1). In this example, two light emission units 33L-m and 33L-m+1 adjacent to each other differ from each other in at least two of the light emission parameters in each time interval ti_j of the second period Tp2. That is, every pair of two adjacent light emission units differ in at least two of the light emission parameters in each time interval ti_j of the second period Tp2.

In this example, the emission intensity cd of each of the plurality of light emission units 33L is the first intensity cd1 ("100" in the table 400L) at the end point t10 of the second period Tp2. The emission intensity cd of each of the plurality of light emission units 33L is kept at the first intensity cd1 from the point t10 to the point t14.

As long as the emission intensity cd of each of the plurality of light emission units 33L is the first intensity cd1 at the end point t14 of the first period Tp1, the emission intensity cd of one of the plurality of light emission units 33L and the emission intensity cd of another of the plurality of light emission units 33L may reach the first intensity cd1 at different times. For instance, the emission intensity cd of the light emission unit 33L-1 may take a value lower than the first intensity cd1 at the point t10 to reach the first intensity cd1 at the point t12.

The lighting ECU 10 ends the specific lighting control after the length of time elapsed since the on-point reaches the first time Tm1 (that is, immediately after the end point t14 of the first period Tp1). The lighting ECU 10 decreases the emission intensity cd of each of the plurality of light emission units 33L to zero.

The lighting ECU 10 thus increases the emission intensity cd of each of the plurality of light emission units 33L to the first intensity cd1 in response to operation performed on the starter switch 50. The lighting ECU 10 further changes the emission intensity cd of each of the plurality of light emission units 33L in an irregular pattern in the second period Tp2. With the emission intensity cd of each of the plurality of light emission units 33L increasing and changing in an irregular pattern, the lighting ECU 10 is more successful in drawing the attention of people present around the vehicle than the related-art device. The lighting ECU 10 can more effectively call the attention of people present around the vehicle before the vehicle starts to move.

Further features of the at least one embodiment are described next. As shown in FIG. 5, sums of values each indicating the emission intensity cd of one of "n" light emission units (33L-1, 33L-2, 33L-3, . . . , 33L-n) at each point (t0, . . . , t10) in the second period Tp2 are notated as "SL_t0", . . . , "SL_t10", respectively. According to the table 400L, the sum values of the emission intensity cd gradually increase in the second period Tp2. A relationship expressed by Expression 1 is accordingly established.

$$SL_t0<SL_t1<SL_t2<SL_t3<SL_t4<SL_t5<SL_t6<SL_t7<SL_t8<SL_t9<SL_t10 \quad \text{(Expression 1)}$$

In this manner, the lighting ECU 10 changes the emission intensity cd of each of the plurality of light emission units 33L so that the sum values of the emission intensity cd gradually increase in the second period Tp2 in accordance with the table 400L. The degree of overall brightness of the plurality of light emission units 33L gradually increases without dropping at some point. This enhances the effect of drawing the attention of people present around the vehicle even more.

The lighting ECU 10 further changes the emission intensity cd of each of the plurality of light emission units 33L so that the emission intensity cd of each of the plurality of light emission units 33L falls within a predetermined range at each point (t0, . . . , t10) in the second period Tp2 in accordance with the table 400L.

For this configuration, the table 400L may be created in a manner described below. As shown in FIG. 6, a reference value cd_ref of the emission intensity cd at each point (t1, . . . , t9) in the second period Tp2 is set first. The reference value cd_ref is set so as to increase with time. A value larger than the reference value cd_ref by a predetermined value dw (a positive value) is set next as an upper limit value of the range of the emission intensity cd. A value smaller than the reference value cd_ref by the predetermined value dw is further set as a lower limit value of the range of the emission intensity cd. The predetermined value dw is, for example, "10% to 50% of the reference value cd_ref." In this example, the predetermined value dw is 50% of the reference value cd_ref. In this case, the reference value cd_ref at the point t1, for example, is "10", which sets the predetermined value dw to 5, and the range of the emission intensity cd at the point t1 is accordingly from 5 to 15.

The predetermined value dw is not limited to a proportion of the reference value cd_ref, and may be set to a specific numerical value of the emission intensity cd. The predetermined value dw in this case is a value larger than 0 and smaller than the reference value cd_ref.

According to the configuration described above, the emission intensity cd of each of the plurality of light emission units 33L falls within a predetermined range at each point (t1, . . . , t9) in the second period Tp2. Each of the plurality of light emission units 33L can accordingly be prevented from being reduced and increased in emission intensity cd to an extreme level. This enables a smooth increase of the emission intensity cd of each of the plurality of light emission units 33L to the first intensity cd1.

The lighting ECU 10 executes the specific lighting control for the right high beam light 31R as well in the same manner. The plurality of light emission units in the right high beam light 31R are hereinafter collectively referred to as "a plurality of light emission units 33R."

The lighting ECU 10 stores a table 400R shown in FIG. 7 on the ROM 10*c* in advance. The table 400R defines, for each of the plurality of light emission units 33R, changes with time of the emission intensity cd that are observed in the light emission unit when the specific lighting control is executed. In the table 400R, the emission intensity cd of each of the plurality of light emission units 33R is normalized with the first intensity cd1 as "100". The lighting ECU 10 controls the emission intensity cd of each of the plurality of light emission units 33R based on the table 400R and the time elapsed since the on-point.

According to the table 400R, in each time interval ti_j of the second period Tp2 and each pair of two adjacent light emission units 33R, the adjacent light emission units 33R differ from each other in at least two of the light emission parameters. Any one light emission unit out of the plurality of light emission units 33R is expressed as "light emission unit 33R-m" (m=1, . . . , n−1). In this example, in each time interval ti_j of the second period Tp2, two adjacent light emission units 33R-m and 33R-m+1 differ from each other in at least two of the light emission parameters.

The table 400R is set so that a pattern of changes in emission intensity cd of the plurality of light emission units 33R in the second period Tp2 differs from a pattern of changes in emission intensity cd of the plurality of light emission units 33L in the second period Tp2. For instance, the light emission unit 33R-1 and the light emission unit 33L-1 differ from each other in light emission parameters (for example, the magnitude of the changing amount of the emission intensity cd in the first time interval ti_1 and the emission intensity cd at the end point of the first time interval ti_1). The plurality of light emission units 33R and the plurality of light emission units 33L thus change in emission intensity cd in patterns different from each other in the second period Tp2. The effect of drawing the attention of people present around the vehicle can accordingly be enhanced even more.

Sums of values each indicating the emission intensity cd of one of "n" light emission units (33R-1, 33R-2, 33R-3, . . . , 33R-n) at each point (t0, . . . , t10) of the second period Tp2 are notated as "SR_t0", . . . , "SR_t10", respectively. A relationship expressed by Expression 2 is established in the table 400R as well.

$$SR_t0<SR_t1<SR_t2<SR_t3<SR_t4<SR_t5<SR_t6<SR_t7<SR_t8<SR_t9<SR_t10 \quad \text{(Expression 2)}$$

The table 400R may be created in a manner described below. As shown in FIG. 8, a reference value cd_ref is set for the emission intensity cd at each point (t1, . . . , t9) in the second period Tp2. A value larger than the reference value cd_ref by the predetermined value dw is set as an upper limit value of the range of the emission intensity cd. A value smaller than the reference value cd_ref by the predetermined value dw is further set as a lower limit value of the range of the emission intensity cd. The predetermined value dw is, as described above, 50% of the reference value cd_ref. The emission intensity cd of each of the plurality of light emission units 33R accordingly falls within a predetermined range at each point (t1, . . . , t9) in the second period Tp2.

<Operation>

Operation of the CPU 10*a* (hereinafter simply referred to as "CPU") of the lighting ECU 10 is described next. The CPU is configured to execute a "specific lighting control execution routine" illustrated in a flow chart of FIG. 9, each time a predetermined length of time elapses.

Figure 9:
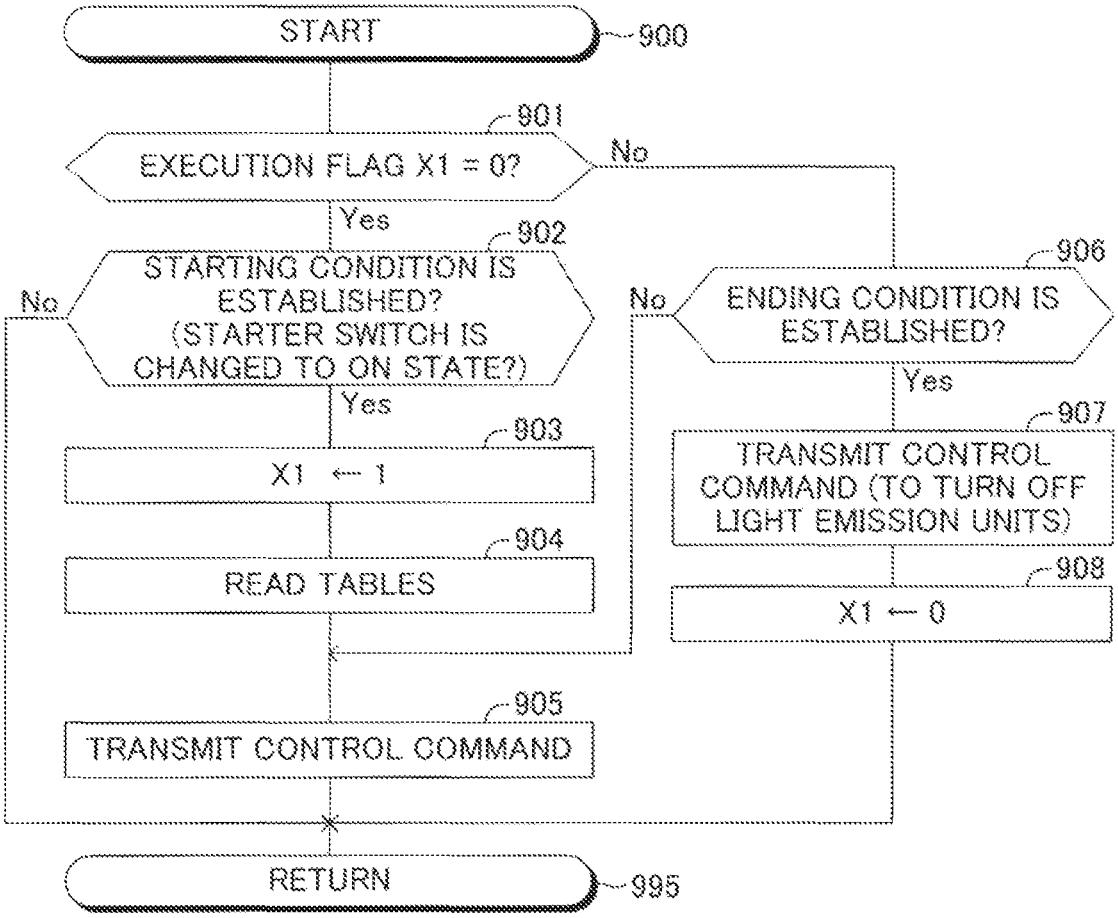
FIG. 9 is an illustration of a flow chart for illustrating a "specific lighting control execution routine" executed by a CPU of a lighting ECU 10.

At predetermined timing, the CPU starts processing from Step 900 of FIG. 9 and proceeds to Step 901 to determine whether an execution flag X1 has a value "0". The execution flag X1 indicates that the specific lighting control is not being executed when the value of the execution flag X1 is "0". The execution flag X1 indicates that the specific lighting control is being executed when the value of the execution flag X1 is "1".

Here, the value of the execution flag X1 is assumed to be "0". Then, the CPU determines that the answer is "Yes" in Step 901, and proceeds to Step 902 to determine whether a predetermined starting condition is established. The starting condition is established when the state of the starter switch 50 is changed from the off state to the on state. When the starting condition is not established, the CPU determines that the answer is "No" in Step 902, and proceeds directly to Step 995 to end this routine once.

When the starting condition is established, on the other hand, the CPU determines that the answer is "Yes" in Step 902, and sequentially executes processing of Step 903 to processing of Step 905 described below. The CPU then proceeds to Step 995 to end this routine once.

Step 903: The CPU sets the value of the execution flag X1 to "1".

Step 904: The CPU reads the tables 400L and 400R out of the ROM 10*c*.

Step 905: The CPU transmits a control command to each of the plurality of light emission units 33L of the left high beam light 31L, based on the table 400L and the length of time elapsed since the on-point. The CPU also transmits a control command to each of the plurality of light emission units 33R of the right high beam light 31R, based on the table 400R and the length of time elapsed since the on-point. The CPU executes the specific lighting control in this manner.

After starting the specific lighting control, the CPU resumes the routine of FIG. 9. The CPU proceeds to Step 901, determines that the answer is "No", and consequently proceeds to Step 906. The CPU determines whether a predetermined ending condition is established. The ending condition is established when the length of time elapsed since the on-point (in this example, a point at which Step 903 is executed) reaches the first time Tm1. When the ending condition is not established, the CPU determines that the answer is "No" in Step 906, and proceeds to Step 905 to continue the specific lighting control.

When the ending condition is established, on the other hand, the CPU determines that the answer is "Yes" in Step 906, and sequentially executes processing of Step 907 and processing of Step 908 described below. The CPU then proceeds to Step 995 to end this routine once.

Step 907: The CPU transmits a control command to each of the plurality of light emission units 33L of the left high beam light 31L to decrease the emission intensity cd of each of the plurality of light emission units 33L to zero. The CPU also transmits a control command to each of the plurality of light emission units 33R of the right high beam light 31R to decrease the emission intensity cd of each of the plurality of light emission units 33R to zero. The CPU ends the specific lighting control in this manner.

Step 908: The CPU sets the value of the execution flag X1 to "0".

The lighting device having the configuration described above increases the emission intensity cd of each of the plurality of light emission units 33L and each of the plurality of light emission units 33R to the first intensity cd1 in response to operation performed on the starter switch 50. Until the emission intensity cd of each of the plurality of light emission units 33L and each of the plurality of light emission units 33R reaches the first intensity cd1 (that is, during the second period Tp2), the lighting device changes the emission intensity cd of each of the plurality of light emission units 33L and each of the plurality of light emission units 33R in an irregular pattern.

As described above, the related-art device merely shifts the light emission area in one direction and accordingly fails to draw the attention of people present around the vehicle in some cases. The lighting device according to the at least one embodiment, on the other hand, increases the degree of brightness of each of the plurality of light emission units 33L and 33R, and simultaneously changes the emission intensity cd of each of the plurality of light emission units 33L and each of the plurality of light emission units 33R in an irregular pattern. The lighting device is thus more effective in drawing the attention of people present around the vehicle than the related-art device.

The present invention is not limited to the at least one embodiment described above, and various modification examples can be adopted within the scope of the present invention.

Modification Example 1

The second period Tp2 is not limited to the example described above (the period from the point t0 to the point t10). The second period Tp2 is only required to be at least a period that is a part of the first period Tp1. For example, the lighting ECU 10 may follow a table 400L_a shown in FIG. 10 in executing the specific lighting control. In the table 400L_a, the second period Tp2 is a period from the point t3 to the point t9. According to this configuration, the emission intensity cd of each of the plurality of light emission units 33L regularly (in increments of 10) increases in a period from the point t0 to the point t3, and irregularly changes in the period from the point t3 to the point t9. The attention of people present around the vehicle can be drawn with this irregular change in emission intensity cd. In another example, the second period Tp2 may be the same as the first period Tp1, that is, may be the period from the point t0 to the point t14.

Modification Example 2

In the example described above, the light emission units in every pair of adjacent light emission units differ from each other in at least two of the light emission parameters in each time interval ti_j of the second period Tp2. The lighting device, however, is not limited thereto. The effect described above can be obtained as long as the light emission units in at least one pair of light emission units adjacent to each other differ from each other in at least two of the light emission parameters in each time interval ti_j of the second period Tp2.

For example, the lighting ECU 10 may follow a table 400L_b shown in FIG. 11 in executing the specific lighting control. According to the table 400L_b, the emission intensity cd of the light emission unit 33L-1 irregularly increases in the second period Tp2. For the rest of the light emission units (the light emission units 33L-2, . . . , 33L-n), on the other hand, the emission intensity cd regularly (in increments of 10) increases in the second period Tp2. According to this configuration, in each time interval ti_j of the second period Tp2, the light emission units (33L-1 and 33L-2) in only one pair of adjacent light emission units differ from each other in at least two of the light emission parameters. With some of the light emission units 33L irregularly changing in emission intensity cd, the attention of people present around the vehicle can be drawn.

Modification Example 3

In the example described above, the emission intensity cd of every one of the light emission units 33L is the first intensity cd1 at the end point t14 of the first period Tp1. The lighting device, however, is not limited thereto. The emission intensity cd of at least one of the plurality of light emission units 33L may be higher than the first intensity cd1 at the end point t14 of the first period Tp1. The specific lighting control may accordingly be control in which the emission intensity cd of each of the plurality of light emission units 33L is equal to or higher than the first intensity cd1 at the end point of the first period Tp1.

Modification Example 4

The relationships of Expression 1 and Expression 2 may not be established. In the second period Tp2, the sums of values each indicating the emission intensity cd may drop at some point before gradually increasing.

Modification Example 5

Figure 12:
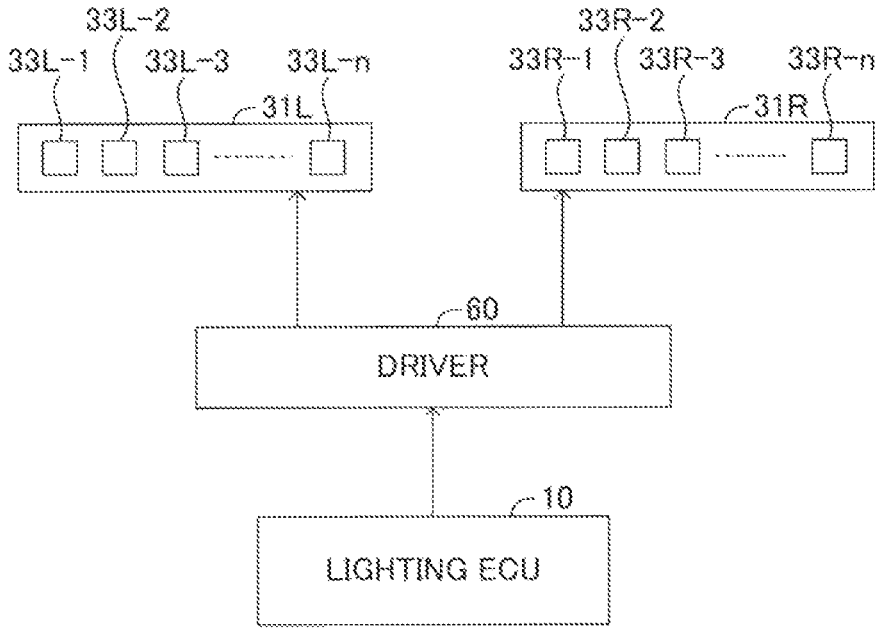
FIG. 12 is a modification example of a configuration for controlling the left high beam light and the right high beam light.

As illustrated in FIG. 12, the lighting device may further include a driver 60. The driver 60 includes an ECU configured to control the plurality of light emission units 33L of the left high beam light 31L and the plurality of light emission units 33R of the right high beam light 31R. In this configuration, the driver 60 stores the table 400L and the table 400R in advance. The lighting ECU 10 transmits a predetermined start command to the driver 60 when the starting condition is established. In response to the start command, the driver 60 executes the specific lighting control based on the tables 400L and 400R. The lighting ECU 10 transmits a predetermined end command to the driver 60 when the ending condition is established. In response to the end command, the driver 60 ends the specific lighting control.

In another example, the lighting ECU 10 may transmit information about the reference value cd_ref of the emission intensity cd that is shown in FIG. 6 to the driver 60 when the starting condition is established. The driver 60 may change the emission intensity cd of each of the plurality of light emission units 33L in the second period Tp2, at random within the range of emission intensity shown in FIG. 6, based on the reference value cd_ref.

Modification Example 6

In the example described above, the left high beam light 31L and the right high beam light 31R each include light emission units aligned in a single line in the vehicle width direction. The lighting device, however, is not limited thereto. The left high beam light 31L and the right high beam light 31R may each include light emission units aligned in a plurality of lines in the vehicle width direction. In this configuration, the lighting ECU 10 may change the emission intensity of each of the plurality of light emission units in each time interval ti_j of the second period Tp2 so that vertically adjacent light emission units differ from each other in at least two of the light emission parameters.

Modification Example 7

In the at least one embodiment described above, maximum output of the emission intensity of each of the plurality of light emission units may take a maximum value of the range of emission intensity (see FIG. 6 and FIG. 8). The lighting device, however, is not limited thereto. An upper limit value may be set for the emission intensity of each of the plurality of light emission units in order to avoid a trouble caused in the light emission unit by an excessively high emission intensity. In the at least one embodiment, the tables 400L and 400R may define the emission intensity of each of the plurality of light emission units so that this upper limit value is not exceeded. In the at least one embodiment, the first intensity cd1 may be set to this upper limit value.

What is claimed is:

1. A lighting device for a vehicle, comprising:

a plurality of light emission units mounted in a front part of the vehicle and aligned in a predetermined direction;

a control device configured to control an emission intensity of each of the plurality of light emission units; and an operating unit to be operated by a driver when a driving source of the vehicle is started, the control device being configured to execute a specific lighting control in which the emission intensity of each of the plurality of light emission units is changed so that the emission intensity of each of the plurality of light emission units is equal to or higher than a predetermined first intensity at an end point of a first period, the first period being a period that starts from an operation point at which the operating unit is operated and ends when a length of time elapsed since the operation point reaches a predetermined first time, the first period including a second period, the second period including a plurality of time intervals, the control device being configured to execute the specific lighting control so that, in each of the plurality of time intervals of the second period, the light emission units in at least one pair of light emission units adjacent to each other out of the plurality of light emission units differ from each other in light emission parameters, the light emission parameters including at least two parameters out of a magnitude of a changing amount of the emission intensity in each of the plurality of time intervals, a direction indicating whether the emission intensity is increasing or decreasing in each of the plurality of time intervals, and the emission intensity at an end point of each of the plurality of time intervals.

2. The lighting device for a vehicle according to claim 1, wherein the control device is configured to execute the specific lighting control so that a sum of values each indicating the emission intensity of each of the plurality of light emission units gradually increases in the second period.

3. The lighting device for a vehicle according to claim 1, wherein the control device is configured to execute the specific lighting control so that the emission intensity of each of the plurality of light emission units falls within a predetermined range at an end point of each of the plurality of time intervals.

4. The lighting device for a vehicle according to claim 1, wherein the plurality of light emission units include a plurality of first light emission units provided on a left side of the front part of the vehicle, and a plurality of second light emission units provided on a right side of the front part of the vehicle, wherein the control device is configured to:

execute the specific lighting control so that, in each of the plurality of time intervals of the second period, the first light emission units in at least one pair of the first light emission units adjacent to each other out of the plurality of first light emission units differ from each other in the light emission parameters; and execute the specific lighting control so that, in each of the plurality of time intervals of the second period, the second light emission units in at least one pair of the second light emission units adjacent to each other out of the plurality of second light emission units differ from each other in the light emission parameters, and wherein, in the second period, a pattern of changes in the emission intensity of each of the plurality of first light emission units and a pattern of changes in the emission intensity of each of the plurality of second light emission units differ from each other.

* * * * *